US008646887B2

(12) United States Patent
Ogura et al.

(10) Patent No.: US 8,646,887 B2
(45) Date of Patent: Feb. 11, 2014

(54) LIQUID CARTRIDGE AND LIQUID JET APPARATUS

(75) Inventors: Hideki Ogura, Yokohama (JP); Yasuo Kotaki, Yokohama (JP); Tatsuo Nanjo, Kawasaki (JP); Takatoshi Kitagawa, Kawasaki (JP); Keisuke Matsuo, Yokohama (JP); Norihiro Ikebe, Kawasaki (JP); Eiichiro Shimizu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 172 days.

(21) Appl. No.: 13/108,712

(22) Filed: May 16, 2011

(65) Prior Publication Data

US 2011/0285797 A1 Nov. 24, 2011

(30) Foreign Application Priority Data

May 21, 2010 (JP) ..... 2010-117251

(51) Int. Cl.
*B41J 2/17* (2006.01)
*B41J 2/175* (2006.01)

(52) U.S. Cl.
USPC ..... 347/86; 347/84

(58) Field of Classification Search
USPC ..... 347/84, 85, 86
See application file for complete search history.

(56) References Cited

U.S. PATENT DOCUMENTS

| | | | | |
|---|---|---|---|---|
| 5,221,935 | A * | 6/1993 | Uzita | 347/36 |
| 5,883,653 | A | 3/1999 | Sasaki | |
| 7,690,759 | B2 * | 4/2010 | Yamada | 347/36 |
| 2007/0030302 | A1 | 2/2007 | Yamada | |

FOREIGN PATENT DOCUMENTS

| | | | |
|---|---|---|---|
| CN | 1079691 | A | 12/1993 |
| EP | 478244 | A2 | 4/1992 |
| JP | 59-215870 | A | 12/1984 |
| JP | 05-004349 | A | 1/1993 |
| JP | 05-021749 | A | 3/1993 |
| JP | 2004-001277 | A | 1/2004 |
| JP | 2006-082290 | A | 3/2006 |

* cited by examiner

*Primary Examiner* — Matthew Luu
*Assistant Examiner* — Renee I Wilson
(74) *Attorney, Agent, or Firm* — Canon USA Inc. IP Division

(57) ABSTRACT

The liquid cartridge includes a housing configured to accommodate the liquid container for storing liquid, a groove portion formed on an outer surface of the housing, a liquid lead-out opening, formed on a bottom surface of the groove portion communicating with the liquid container and configured such that the liquid lead-out path for guiding the liquid inside the liquid container to the outside is connected to or disconnected from the liquid lead-out path, a flow path extending toward the inside of the housing from an end of the groove portion in a liquid dripping direction, and a liquid absorbing member provided at an end opposite to the groove portion of the flow path.

10 Claims, 11 Drawing Sheets

LIQUID CARTRIDGE AND LIQUID JET APPARATUS

BACKGROUND OF THE INVENTION

1. Field of the Invention

The present invention relates to a liquid cartridge mountable to a liquid jet apparatus, such as an ink jet printer, and a liquid jet apparatus.

2. Description of the Related Art

Japanese Patent Laid-open Publication No. 59-215870 discloses an ink cartridge as a liquid cartridge mountable to a liquid jet apparatus such as an ink jet printer. As it is illustrated in FIGS. 11A and 11B, in the ink cartridge disclosed in Japanese Patent Laid-open Publication No. 59-215870, an ink bag 122 is incorporated in an ink cartridge 110.

When the ink cartridge 110 is mounted to a printer as the liquid jet apparatus, a hollow needle 140 provided in a printer body pierces through a rubber stopper 126 to establish a communication between the ink cartridge 110 and the printer. Accordingly, an ink can be extracted from the ink bag 122. When the ink cartridge 110 is attached to or detached from the printer, a little amount of ink may be leaked through a point of the hollow needle 140 or the rubber stopper 126. The leaked ink may adhere to a surface of the rubber stopper 126 to get a user's hands dirty while the user handles the ink cartridge 110 and to contaminate parts included in the printer body.

Japanese Patent Laid-open Publication No. 59-215870 discloses the rubber stopper 126 attached to the ink cartridge 110 and a capillary channel 127 provided around the rubber stopper 126. An ink absorber 116 communicating with the capillary channel 127 is provided inside the ink cartridge 110. Accordingly, the ink which leaks through the hollow needle 140 and adheres to the rubber stopper 126, comes through the capillary channel 127 to be absorbed by the ink absorber 116.

In the ink cartridge 110 disclosed in Japanese Patent Laid-open Publication No. 59-215870, the leaked ink passes through many slit-like capillary channels 127 provided around the rubber stopper 126. When the capillary channels 127 divided into thin channels having a strong capillary force are used, the ink inside the capillary channels 127 is held by the capillary force and thus the ink may remain in the capillary channels 127. Thus, a problem arises that, in a case where the capillary channels 127 are left as they are in the above state, the residual ink may be stuck to close the capillary channels 127 and the ink may remain on a surface of the rubber stopper 126.

When a user uses a continuous printing mode and a high quality sheet, there is a case where the user preliminarily exchanges an ink cartridge with a new ink cartridge before starting the continuous operation of the printer for a long time in order to avoid an ink shortage while the printer is subjected to a continuous operation for a long time. In such a case, the ink cartridge that has not been used-up may be loaded to the printer again when printing is performed in a small quantity. In that case, the ink cartridge may be left for a long period of time before the ink cartridge is loaded to the printer again.

If the ink cartridge is left for a long period of time, as described above, the ink held within a narrow space such as the capillary channel may be stuck to close the capillary channel. If the ink cartridge in the above state is used again, the ink adhering to a surface of the ink cartridge is not guided to an ink absorber. In some cases, the ink may leak outside the ink cartridge.

In Japanese Patent Laid-open Publication No. 59-215870, a rubber stopper 126 is attached to an opening formed in a container composing an ink cartridge 110 and the capillary channels 127 are formed around the rubber stopper 126. Therefore, the ink absorber 116 is positioned so as to contact the rubber stopper 126 inside the opening. As a result, there is such a problem that a free degree in designing the rubber stopper 126 and a neighborhood of the opening degrades.

SUMMARY OF THE INVENTION

The present invention is directed to providing a liquid cartridge and a liquid discharge apparatus.

According to an aspect of the present invention, the liquid cartridge of the present invention includes a housing configured to accommodate a liquid container for storing liquid, a groove portion formed on an outer surface of the housing, a liquid lead-out opening, formed on a bottom surface of the groove portion and communicating with a liquid container, wherein the liquid lead-out opening is configured to connect to or disconnect from a liquid lead-out path that guides liquid inside the liquid container to the outside, a flow path extending toward an inside of the housing from an end of the groove in a liquid dripping direction, and a liquid absorbing member provided at an end opposite to the groove portion in the flow path.

According to another aspect of the present invention, the liquid jet apparatus of the present invention includes the liquid cartridge and the liquid lead-out path to be inserted into the liquid lead-out opening so as to communicate with a liquid container in order to guide the liquid inside the liquid container to the outside. The flow path is positioned downward from the liquid lead-out opening in a vertical direction while the liquid cartridge is loaded on the liquid jet apparatus.

According to the above described configuration, the liquid is not held around the liquid lead-out opening of the housing and thus a tendency of the liquid to stick decreases. Further, since the liquid lead-out opening is positioned away from the flow path, a freedom degree in designing around the liquid lead-out opening is enhanced.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Exemplary embodiments of the present invention are described below with reference to drawings attached hereto. A liquid cartridge of the present invention can be suitably used as an ink cartridge to be loaded into a liquid jet apparatus such as an ink jet printer. However, the present invention is not limited to the above and can be applied to a liquid cartridge that contains any liquid.

Figure 1:
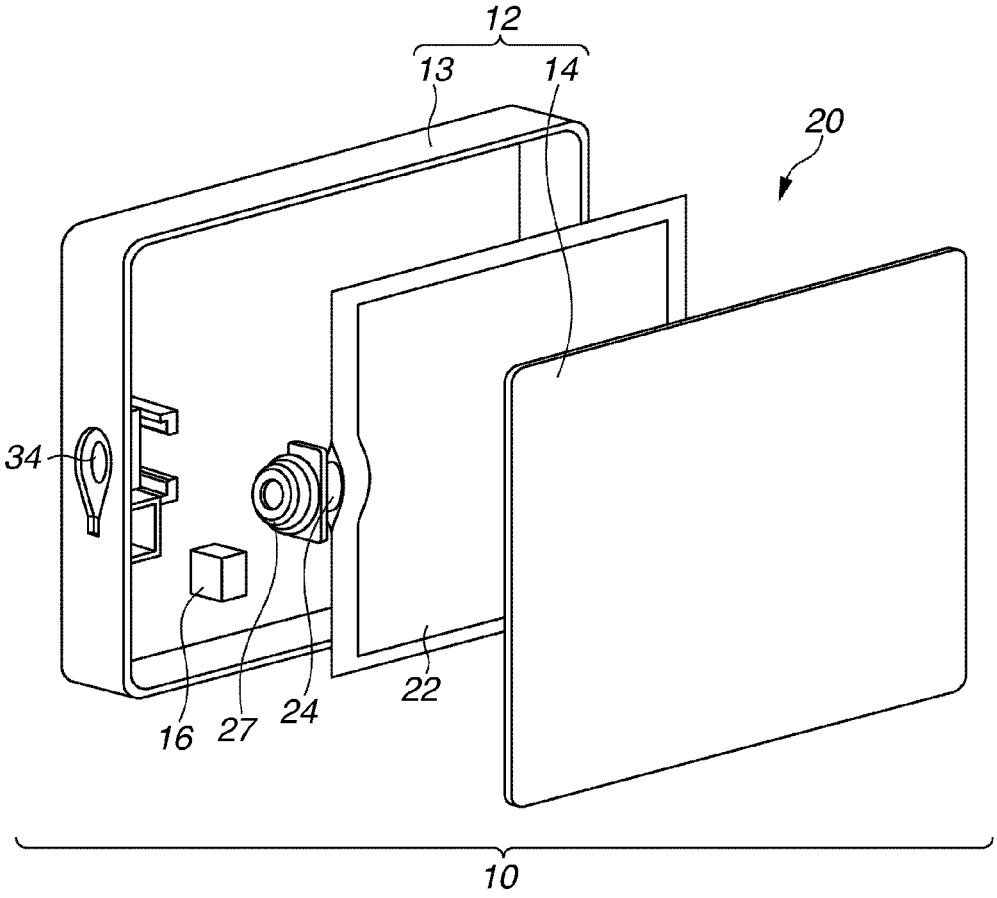
FIG. 1 is an exploded perspective view of a liquid cartridge according to a first exemplary embodiment of the present invention.
Figure 2:
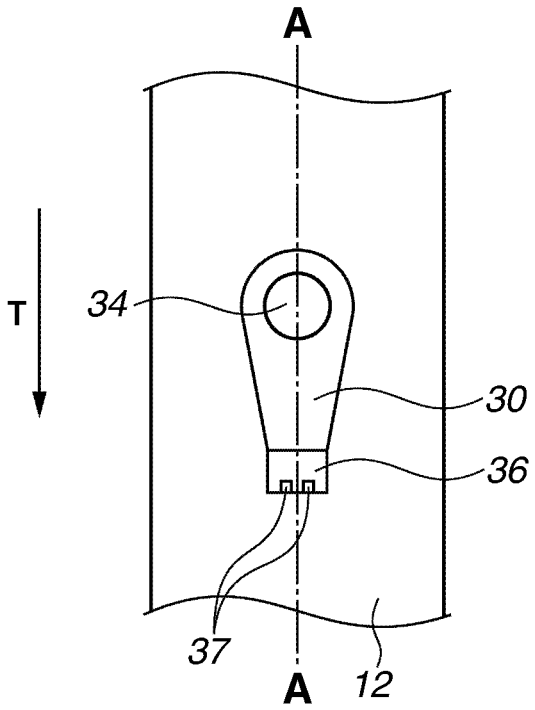
FIG. 2 is a schematic plane view viewed from a side of a liquid lead-out opening in an outer surface of a housing of the liquid cartridge illustrated in FIG. 1.
Figure 3:
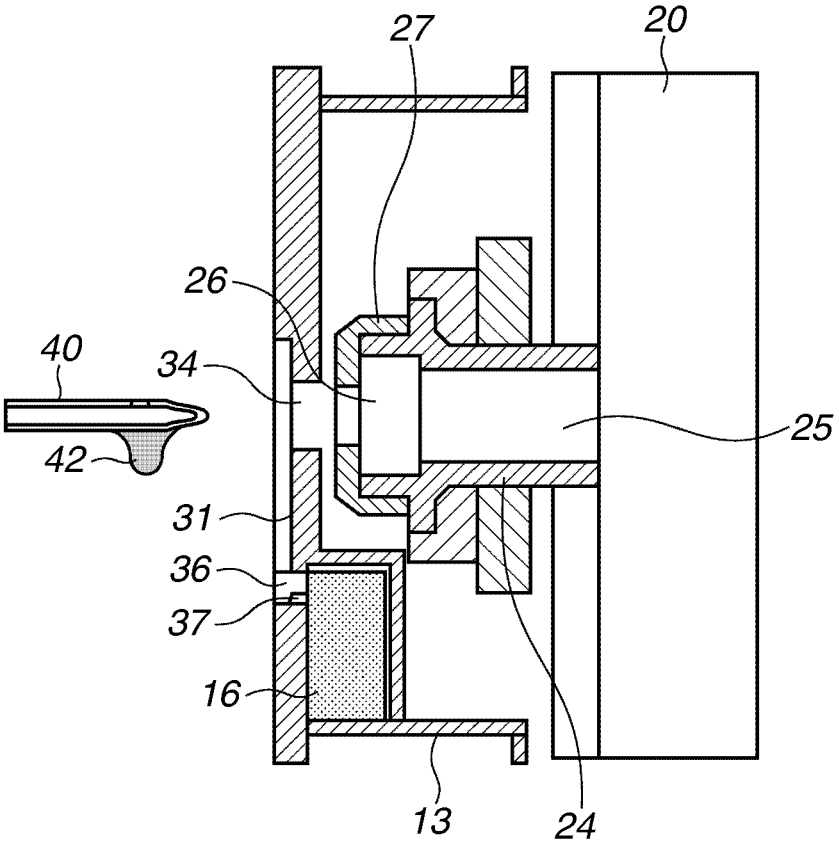
FIG. 3 is a schematic cross sectional view of the liquid cartridge cut along a line A-A of FIG. 2.

FIG. 1 is an exploded perspective view of a liquid cartridge according to a first exemplary embodiment. FIG. 2 is a plane view schematically illustrating the liquid cartridge according to the first exemplary embodiment. FIG. 3 is a schematic cross sectional view cut along a line A-A of FIG. 2. A liquid cartridge 10 includes a housing 12 configured to accommodate a liquid container 20 for storing liquid and a liquid absorbing member 16 provided inside the housing 12.

In the present exemplary embodiment, the housing 12 includes a tank case 13 having a box-like shape with one side opened and a tank cover 14 configured to cover the tank case 13. The housing 12 protects the liquid container 20 inside the housing 12. A flow path forming member 24 including a liquid supply path 25 for supplying the liquid to the outside is secured to the liquid container 20.

Preferably, the liquid container 20 includes a liquid storage bag 22 made of a deformable flexible material. In order to use the liquid completely, it is desirable that the liquid storage bag 22 includes a layer made of a flexible, easy deformable material. An example of the flexible material is a polyethylene film having a high flexibility sandwiched between a nylon film for improving an impact resistance and a polypropylene film as a welded and fixed layer, thereby forming a lamination sheet. As a means for suppressing evaporation of the liquid inside the liquid storage bag 22, a lamination sheet including a film partially using an aluminum layer, or a multi-film formed by a deposition layer of, for example, silica on a PET film as a base member may be used.

Preferably, a layer facing an inside of the liquid storage bag 22 and the flow path forming member 24 are made of the same material such as polypropylene or polyethylene and are sealed to each other by welding. The flow path forming member 24 thermally welded to the liquid storage bag 22 is secured to the tank case 13. The housing 12 is provided with a tank cover 14 in order to protect the liquid container 20 secured to the tank case 13.

Since the flow path forming member 24 is secured to the housing 12, the liquid container 20 is secured to the housing 12. It is preferable that the liquid supply path 25 formed within the flow path forming member 24 is provided with a sealing member 26 for preventing the liquid from being leaked. The sealing member 26 is, for example, made of a rubber stopper as an elastic member. The flow path forming member 24 is provided with a retaining member 27 to prevent the sealing member 26 from coming off. The sealing member 26 may be provided on, instead of the elastic member such as the rubber stopper, the elastic member including an opening that can seal a hollow needle 40 of the body such that the sealing member 26 presses a valve element from a side of the liquid storage bag 22 by using a spring so as to close the opening.

The housing 12 includes a liquid lead-out opening 34 formed and, when the liquid is guided to the outside from the liquid container 20, a hollow needle 40 as a liquid lead-out path is brought into communication with the liquid container 20 through the liquid lead-out opening 34. The rubber stopper 26 is configured such that the hollow needle 40 can pierce through the rubber stopper 26. The hollow needle 40 is provided in, for example, the liquid jet apparatus, and the liquid is supplied to the liquid jet apparatus through the hollow needle 40. For example, the liquid can be guided to the outside through the hollow needle 40 by absorbing an inside of the hollow needle 40.

Preferably, the liquid absorbing member 16 provided inside the housing 12 is made of a porous material having a high water absorbing property. The liquid absorbing member 16 preferably has a porous body such as a sponge and a nonwoven fabric. However, as long as the liquid absorbing member 16 can absorb liquid, the liquid absorbing member 16 may be made of any material.

Now, a configuration around the liquid lead-out opening 34 of the housing 12 is described below. FIG. 2 is a plane view schematically illustrating the liquid cartridge 10 viewed from a side where the liquid lead-out opening 34 is formed. An outer surface of the housing 12 includes a groove portion 30 formed thereon and a bottom surface 31 of the groove portion 30 includes a liquid lead-out opening 34 formed therein, respectively (see FIG. 3). The liquid lead-out opening 34 has a size through which the hollow needle 40 can pass. The groove portion 30 is formed on an outer surface of the housing 12 almost in parallel with the vertical direction and guides the liquid 42 adhering to the bottom surface 31 of the groove portion 30 downwardly in the vertical direction. An end of the groove portion 30 in a liquid dripping direction T, i.e., in a direction the liquid drips along the bottom surface 31 of the groove portion 30, is provided with a liquid introduction port as one end of a flow path 36. The flow path 36 extends toward the inside of the housing 12 from the bottom surface 31 of the groove portion 30. An end of the flow path 36 opposite to the bottom surface 31 of the groove portion 30 is provided with the liquid absorbing member 16.

Preferably, the flow path 36 is a single path including at least one rib 37 on an inner surface thereof. The rib 37 extends along a direction the flow path extends. Accordingly, a thin slit-like groove is formed on the inner surface of the flow path 36 and therefore, a capillary force of the flow path 36 increases. As a result, an effective movement of the liquid can be achieved toward the liquid absorbing member 16.

The rib 37 formed in the flow path 36 does not divide the flow path 36 into a plurality of paths but can exert a predetermined capillary force while keeping a size of the flow path 36. Accordingly, a possible residual liquid remaining in the flow path 36 decreases and therefore a possible closure of the flow path 36 due to sticking of the liquid is reduced. Even if the liquid remaining in the groove of the flow path 36 sticks therein, a possible closure of the entire flow path 36 decreases and thus the function for moving the liquid is kept as it is. A preferable size of the flow path 36 is as large as the entire flow path is not closed while the liquid dripping from the hollow needle 40 moves into the flow path 36.

Now, a migration pathway of a liquid 42 adhering around the liquid lead-out opening 34 of the housing 12 is described below. As it is illustrated in FIG. 3, when the hollow needle 40 is inserted into or drawn out from the liquid lead-out opening 34, the liquid 42 may drip from a tip of the hollow needle 40. This liquid 42 is in a state dripping downward from the hollow needle 40 due to its own weight. This liquid 42 may adhere onto the bottom surface 31 of the groove portion 30 near the liquid lead-out opening 34.

Figure 4A:
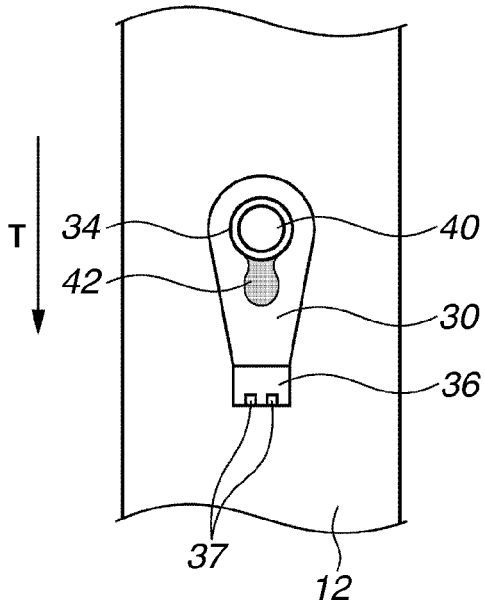
FIGS. 4A through 4D, respectively, are pattern diagrams illustrating a migration pathway of liquid adhering around the liquid lead-out opening in the liquid cartridge according to the first exemplary embodiment.

Now, the migration pathway of the liquid 42 adhering around the liquid lead-out opening 34 is described below with reference to FIG. 4. In FIG. 4A, a state immediately after the liquid 42 adheres around the liquid lead-out opening 34 is illustrated. The liquid cartridge 10 is positioned such that the flow path 36 is oriented downwardly in the vertical direction (i.e., a direction of gravity) from the liquid lead-out opening 34. Accordingly, the liquid 42 adhering around the liquid lead-out opening 34 gradually moves along the bottom surface 31 of the groove due to its own weight to the end of the groove portion 30 in the liquid dripping direction T, i.e., a direction the liquid drips. More specifically, the liquid 42 moves to an inlet port of the flow path 36. The groove portion 30 has such a depth as the liquid 42 does not flow over.

Figure 4B:
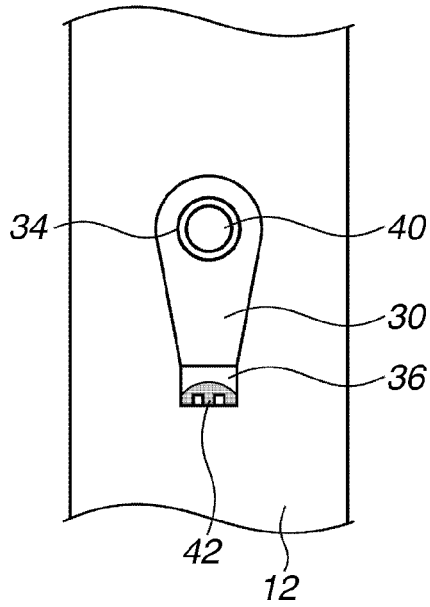

FIG. 4B illustrates a state that the liquid 42 gets together at the inlet port of the flow path 36 provided at the end of the groove portion 30. The groove portion 30 has a sufficient width (i.e., a width in a direction orthogonal to the liquid dripping direction T) such that the liquid 42 does not flow over the groove portion 30. Preferably, the width of the groove portion 30 in a direction orthogonal to the liquid dripping direction T becomes narrower as it goes in the liquid dripping direction T, in a downstream side of the liquid lead-out opening 34 in the liquid dripping direction T. In other words, side surfaces of the groove portion 30 slope down in a vertical direction. Accordingly, the liquid 42 flows smoothly in the liquid dripping direction T and, even if the flow path 36 is a single path, the liquid 42 can be guided to the inlet port of the flow path 36.

Figure 4C:
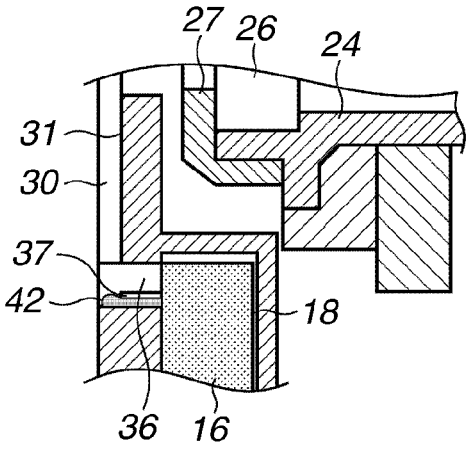

FIG. 4C illustrates a state that the liquid 42 having moved to the inlet port of the flow path 36 is guided to the liquid absorbing member 16 provided inside the housing 12 through the flow path 36. As described above, the rib 37 is formed in the flow path 36. The capillary force generated by this rib 37 causes the liquid 42 to be drawn into the flow path 36 toward the inside of the housing 12.

Figure 4D:
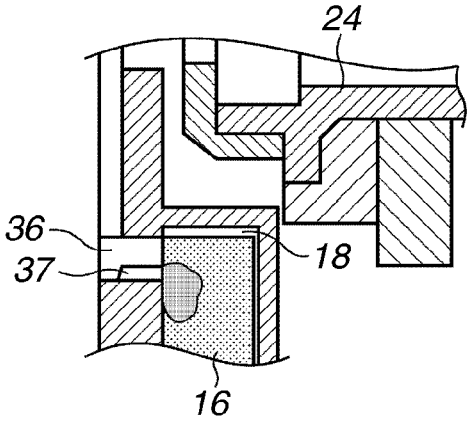

FIG. 4D illustrates a state that the liquid 42 drawn into the flow path 36 is absorbed by the liquid absorbing member 16. The liquid 42 drawn into the flow path 36 is absorbed from a portion contacting the liquid absorbing member 16. The liquid absorbing member 16 having the capillary force stronger than the capillary force of the flow path 36 is used. Therefore, the liquid 42 moves smoothly and a possible residual liquid 42 in the flow path 36 decreases. The liquid absorbing member 16 is preferably positioned inside the absorber chamber 18 provided inside the housing 12.

As described above, the liquid 42 flows smoothly due to its own weight along the bottom surface of the groove portion 30, so that the liquid 42 is not held by the bottom surface of the groove portion 30 oriented to the outer surface of the housing 12. Therefore, the possible sticking of the liquid 42 in the groove portion 30 decreases. It is preferable that, even in a case where the user causes the hollow needle 40 to be loaded to the liquid cartridge 10 for several times, the liquid absorbing member 16 has a sufficient size for absorbing the liquid dripping at the time. An amount of the liquid 42 that drips at one loading differs according to a configuration of the hollow needle 40. For example, if the amount of the liquid 42 dripping at one loading is about 0.1 g at a maximum, it is preferable that the liquid absorbing member 16 has the size which can absorb at least the amount of the liquid 42 equal to or more than 0.2 g.

According to the above descried configuration, the liquid lead-out opening 34 formed in the groove portion 30 is provided away from the inlet port of the flow path 36. Therefore, the liquid absorbing member 16 can be provided at a position away from the liquid lead-out opening 34. As a result, the freedom in designing around the liquid lead-out opening 34 of the liquid cartridge 10 improves.

Figure 5:
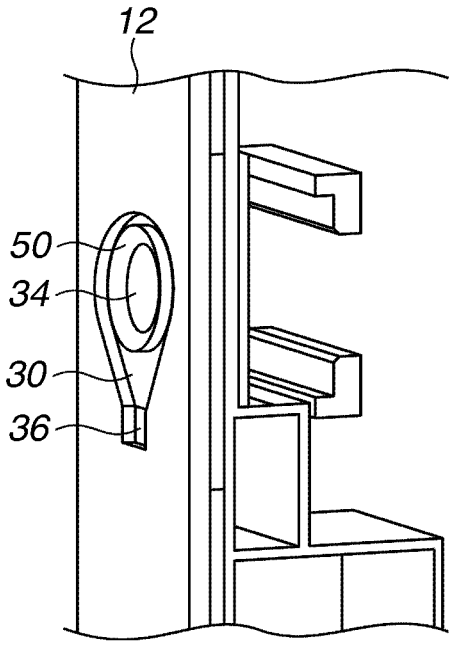
FIG. 5 is a perspective view schematically illustrating a modification example of the liquid cartridge according to the first exemplary embodiment.

FIG. 5 illustrates a modification example of the liquid cartridge according to the present exemplary embodiment. As illustrated in FIG. 5, a projection portion 50 for guiding the hollow needle 40 to the liquid lead-out opening 34 of the groove portion 30 is formed on the bottom surface 31 of the groove portion 30. Accordingly, a reliability of the hollow needle 40 at the time of loading can be enhanced. More specifically, the projection portion 50 includes a slope that encircles the liquid lead-out opening 34 and declines toward the liquid lead-out opening 34. In this case, as described in the following second exemplary embodiment, the liquid 42 adhering around the liquid lead-out opening 34 is guided to the side surfaces of the groove portion 30 by the projection portion 50.

The liquid cartridge according to the second exemplary embodiment of the present invention is described below with reference to FIGS. 6 and 7. A liquid cartridge 60 according to the second exemplary embodiment controls an atmospheric pressure inside the housing 12 and pressurizing a flexible liquid storage bag 22 included in the liquid container 20, thereby guiding the liquid to the outside through the hollow needle 40. For example, in the liquid jet apparatus such as a printer for wide-format printing and high-speed printing, in order to improve a supply speed of the liquid, a container room in which the liquid container 20 is accommodated is sealed to increase the atmospheric pressure inside the container room from the outside, thereby performing supply of the liquid.

Figure 6A:
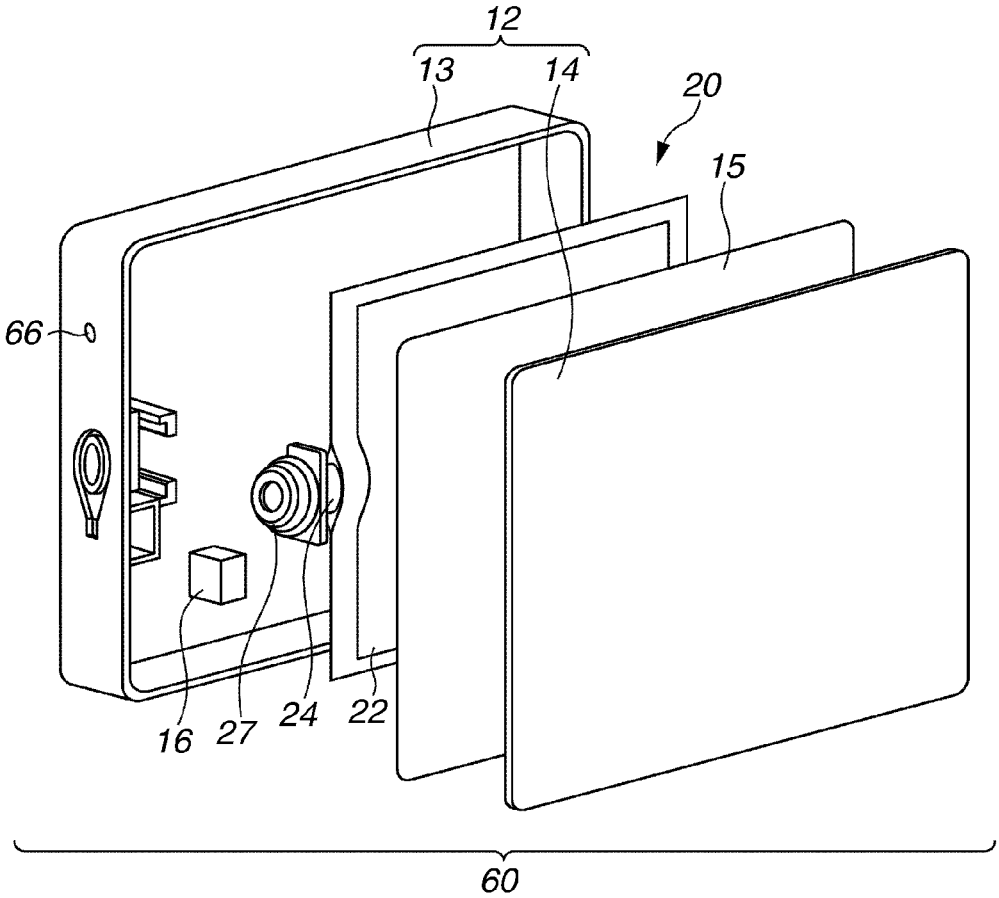
FIGS. 6A and 6B, respectively, are exploded perspective views illustrating a liquid cartridge according to a second exemplary embodiment of the present invention.
Figure 6B:
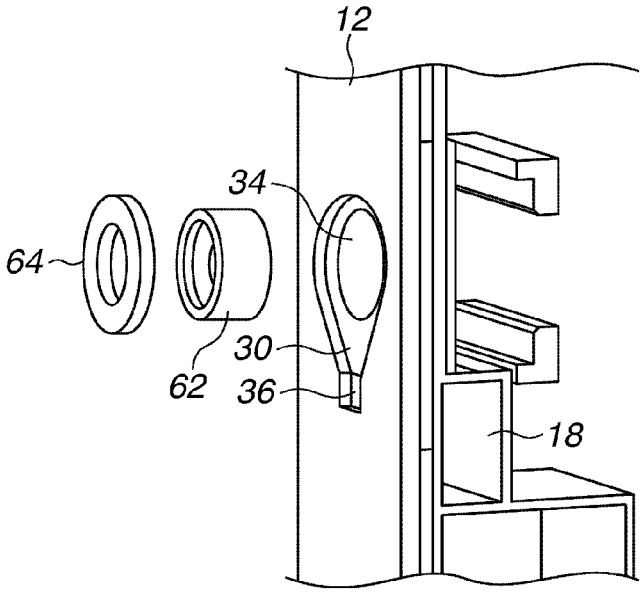
Figure 7A:
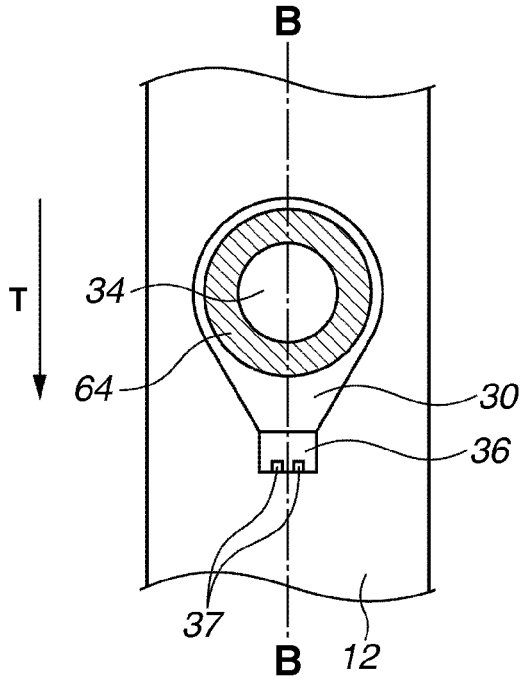
FIG. 7A is a schematic plane view viewed from a side of the liquid lead-out opening in the outer surface of the housing of the liquid cartridge illustrated in FIG. 6.
Figure 7B:
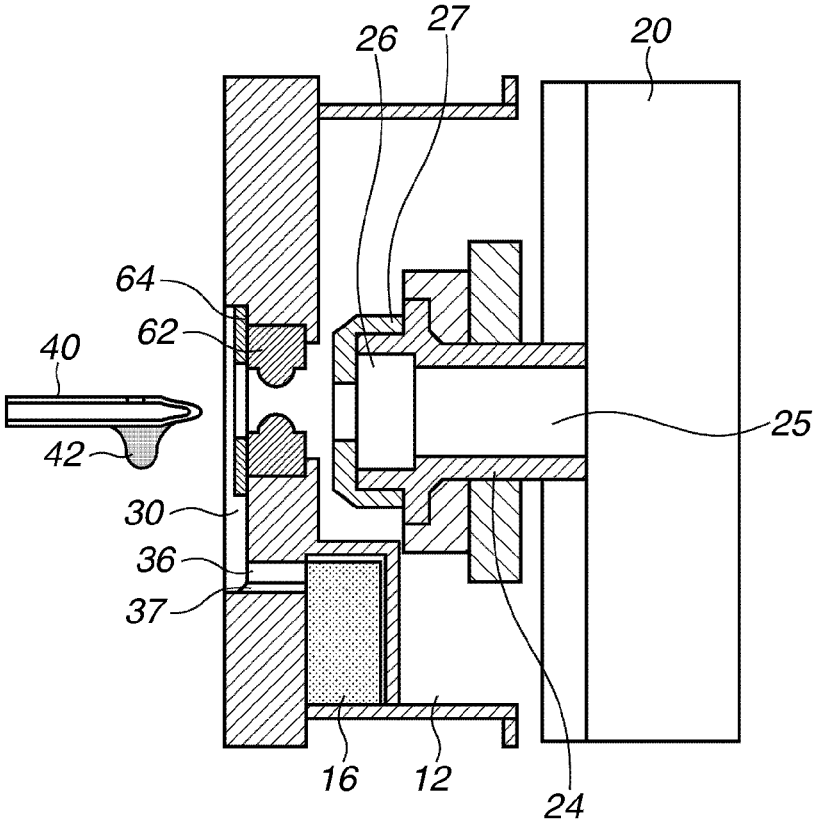
FIG. 7B is a schematic cross sectional view of the liquid cartridge cut along a line B-B of FIG. 7A.

FIG. 6A illustrates an exploded perspective view of the liquid cartridge 60 according to the second exemplary embodiment. FIG. 6B is an enlarged view illustrating an adjacent area of the liquid lead-out opening 34 of FIG. 6A. FIG. 7A is a schematic plane view observed from the side of the liquid lead-out opening 34 of the liquid cartridge 60 according to the second exemplary embodiment and FIG. 7B is a cross section cut along a line B-B of FIG. 7A. In FIGS. 7A and 7B, elements identical to those of the first exemplary embodiment are provided with the same numbers and/or symbols.

In the second exemplary embodiment, in order to seal the container room provided with the liquid container 20, a sealing film 15 is welded to the tank case 13. Further, a sealing rubber 62 configured to seal around the hollow needle 40 and a sealing rubber retaining member 64 configured to press the sealing rubber 62 are provided. The sealing rubber 62 performs sealing when the liquid cartridge 60 is mounted on the liquid jet apparatus and the hollow needle 40 is inserted into the liquid lead-out opening 34. The sealing rubber 62 is configured such that, when the hollow needle 40 is inserted into the liquid lead-out opening 34, the sealing rubber 62 tightly contacts the hollow needle 40. Accordingly, the container room inside the housing 12 is sealed. The sealing rubber retaining member 64 encircles the liquid lead-out opening 34 and forms a projection portion projecting from the bottom surface 31 of the groove portion 30. This sealing rubber retaining member 64 is provided at a position lower than the side surface of the housing 12. Accordingly, even in a case where an ink (i.e., liquid) remains on a surface of the sealing rubber retaining member 64 and the sealing rubber retaining member 64 is placed on a desk or the like with the side surface of the sealing rubber retaining member 64 facing down, the ink is not transferred to the desk. Therefore, the desk is not made dirty.

The housing 12 is provided with an atmospheric pressure control opening 66 formed therein in order to control the atmospheric pressure of the container room provided inside the housing 12. When the liquid cartridge 60 is loaded into the liquid jet apparatus including an atmospheric pressure control mechanism, the atmospheric pressure control mechanism of the liquid jet apparatus controls the atmospheric pressure of the container room through the atmospheric pressure control opening 66. The liquid container 20 includes the liquid storage bag 22 made of the deformable flexible material according to the atmospheric pressure inside the container room.

The absorber chamber 18 including the liquid absorbing member 16 is preferably isolated from the container room. Accordingly, the liquid 42 absorbed by the liquid absorbing member 16 is prevented from adhering to the inside of the container room due to an impact. Since the container room is sealed almost completely except for a position of the atmospheric pressure control opening 66, the atmospheric pressure inside the container room can be controlled.

Figure 8A:
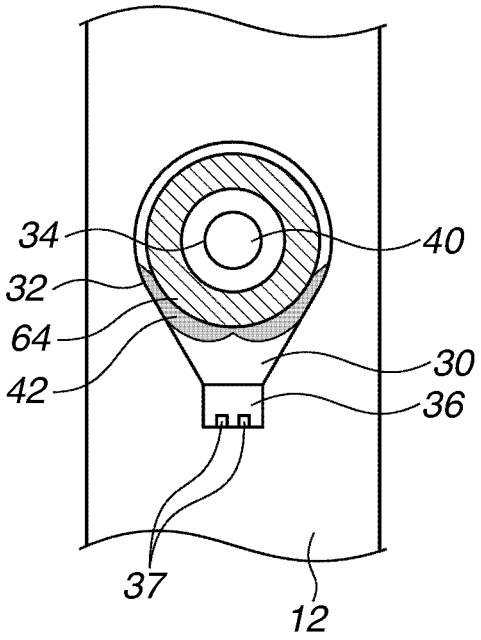
FIGS. 8A through 8C, respectively, are pattern diagrams illustrating a migration pathway of liquid adhering around the liquid lead-out opening in the liquid cartridge according to the second exemplary embodiment.
Figure 8B:
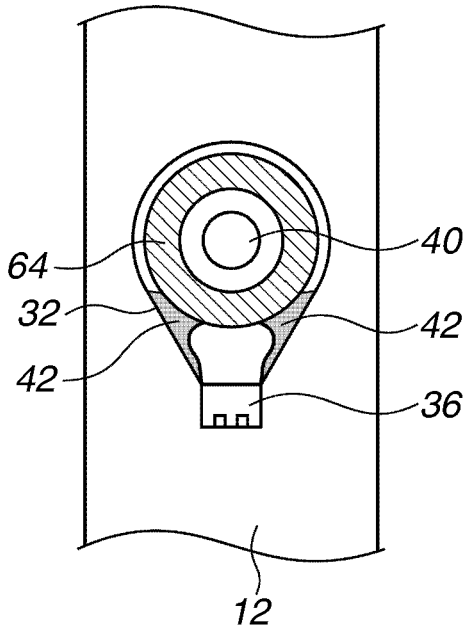
Figure 8C:
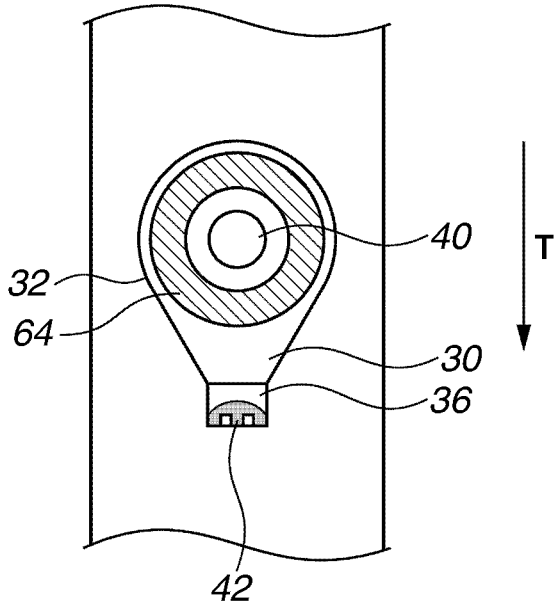

The migration pathway of the liquid 42 adhering around the liquid lead-out opening 34 is described below with reference to FIG. 8. In the second exemplary embodiment, the sealing rubber retaining member 64 as the projection portion is positioned on the bottom surface 31 of the groove portion 30. The liquid 42 adhering around the liquid lead-out opening 34, in addition to the liquid 42 dripping to a center portion of the liquid lead-out opening 34, is guided to a side surface 32 of the groove portion 30 through the sealing rubber retaining member 64. In other words, the liquid 42 adhering to the liquid lead-out opening 34 is once held by the capillary force of the sealing rubber retaining member 64 and the side surface 32 of the groove portion 30 as illustrated in FIG. 8A. Then, the liquid 42 moves along the side surface 32 of the groove portion 30 (see FIG. 8B) and is guided to the inlet port of the flow path 36 (see FIG. 8C). In the downstream side of the liquid lead-out opening 34 in the liquid dripping direction T, a width of the preferable groove portion 30 in a direction orthogonal to the liquid dripping direction T becomes narrower as it goes in the liquid dripping direction T. The liquid 42 flowing along the side surface 32 of the groove portion 30 moves gradually and smoothly. Accordingly, a possibility that a large amount of liquid 42 reaches the inlet port of the flow path 36 at once decreases. Thus, the liquid 42 is prevented from flowing out from the groove portion 30 and a possible accumulation of the liquid 42 in the groove portion 30 also decreases. A flow of the liquid 42 within the flow path 36 is identical to that of the first exemplary embodiment.

Figure 9:
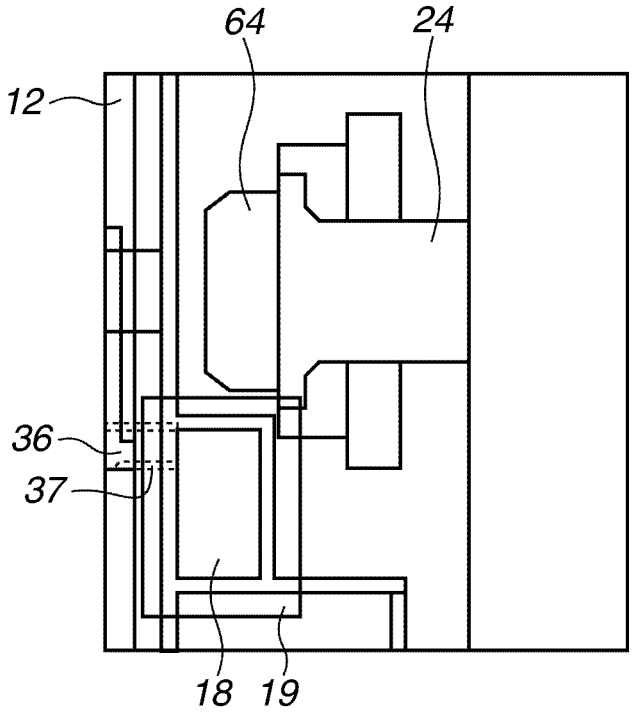
FIG. 9 is a schematic view of an adjacent area of an absorber chamber of a liquid cartridge according to a third exemplary embodiment of the present invention viewed from a side surface of a tank case.

A liquid cartridge according to a third exemplary embodiment of the present invention is described with reference to FIGS. 9 and 10. The liquid cartridge according to the third exemplary embodiment is configured such that the liquid 42 absorbed by the liquid absorbing member 16 does not leak from the liquid absorbing member 16. Normally, the ink absorbed by the liquid absorbing member 16 does not leak owing to a holding force of the liquid absorbing member 16. However, when an impact is caused by falling down or the like or the liquid 42 is absorbed beyond the holding force, the liquid may leak. Accordingly, the liquid 42 may leak outside, running down the surface of the housing 12.

More specifically, the housing 12 includes the absorber chamber 18 accommodating the liquid absorbing member 16. As illustrated in FIG. 9, an absorber chamber cover 19 made of a film or the like is welded onto the absorber chamber 18 and thus the liquid absorbing member 16 is in an enclosed state. In this manner, the liquid 42 is prevented from leaking outside. Accordingly, even if a strong impact is exerted on the liquid cartridge, the liquid 42 absorbed by the liquid absorbing member 16 is prevented from adhering to the other components.

A method or a material for encircling the liquid absorbing member 16 may be anything as long as the liquid 42 can be prevented from leaking. As in the second exemplary embodiment, the absorber chamber 18 may be covered with a sealing film 15 for sealing the container room including the liquid container 20. In this case, parts and manufacturing steps of the liquid cartridge can be reduced.

Figure 10A:
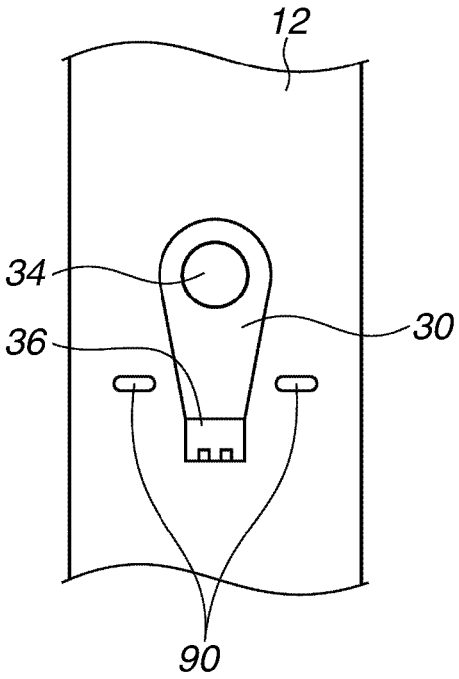
FIGS. 10A and 10B, respectively, are schematic plane views of the liquid cartridge according to the third exemplary embodiment of the present invention viewed from a side in which a liquid lead-out opening is formed.
Figure 10B:
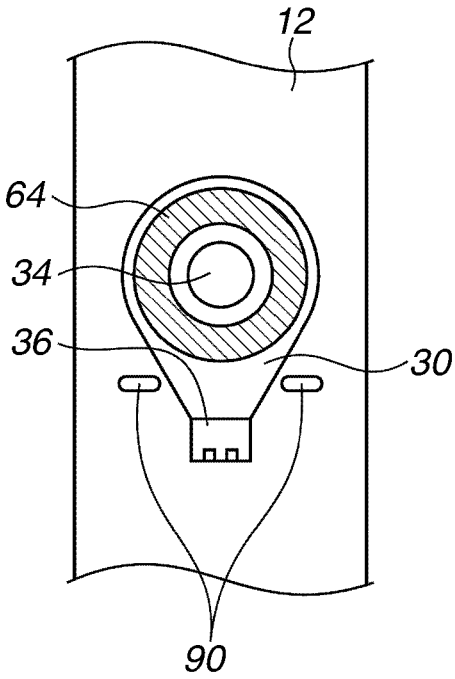
Figure 11A:
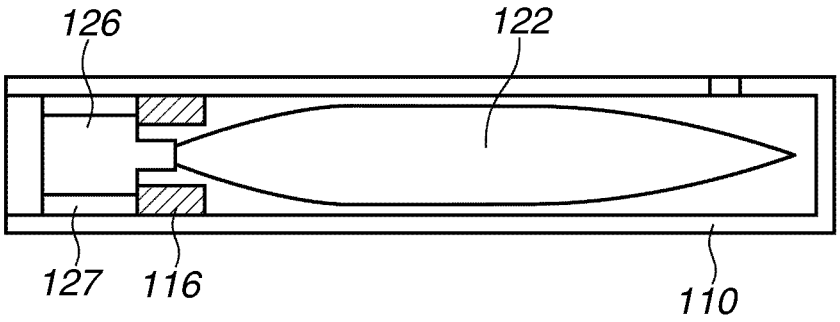
FIG.11A PRIOR ART
FIGS. 11A and 11B, respectively, are schematic views describing a configuration of an ink cartridge disclosed in Japanese Patent Laid-open Publication No. 59-215870.
Figure 11B:
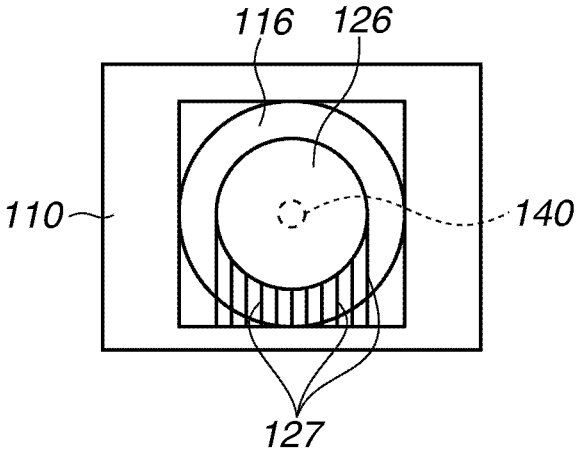
FIG.11B PRIOR ART

Thus, in a case where the absorber chamber 18 is encircled, when the liquid 42 moves within the flow path 36, the liquid 42 moves while exhausting air within the absorber chamber 18. Therefore, the flow path 36 has preferably a size capable of satisfactorily holding the liquid 42 while the liquid 42 is moving. However, in a case where the large amount of liquid 42 drips such that the flow path 36 is closed up, the movement of the liquid 42 may be blocked because there is no space for air inside to escape. Therefore, in addition to the flow path 36, an atmosphere communication port 90 for communicating the absorber chamber 18 with the outside air is preferably formed in the housing 12. With such a configuration, the liquid 42 in the flow path 36 smoothly moves toward the liquid absorbing member 16. The atmosphere communication port 90 is preferably formed in a surface of the housing 12 separately from the bottom surface of the groove portion 30 such that the liquid 42 adhering to the groove portion 30 does not flow into the atmosphere communication port 90 (see FIG. 10). As illustrated in FIGS. 10A and 10B, configurations of the absorber chamber 18 and the atmosphere communication port 90 described in the third exemplary embodiment may be applied to the liquid cartridge of the first exemplary embodiment or may be applied to the liquid cartridge of the second exemplary embodiment. What is required is the forming of at least one atmosphere communication port 90. An end of a side of the absorber chamber 18 of the atmosphere communication port 90 is preferably configured so as not to contact the liquid absorbing member 16 such that the liquid 42 absorbed by the liquid absorbing member 16 does not go out through the atmosphere communication port 90.

The liquid cartridge described in the above exemplary embodiments is preferably used by loading into the liquid jet apparatus. The liquid jet apparatus includes the hollow needle 40 as the liquid lead-out path for guiding the liquid 42 in the liquid container 20. While the liquid cartridge is loaded on the liquid jet apparatus, the flow path 36 is positioned lower than the liquid lead-out opening 34 in the vertical direction. At the time, the hollow needle 40 communicates with the liquid container 20 via the liquid lead-out opening 34.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2010-117251 filed May 21, 2010, which is hereby incorporated by reference herein in its entirety.

What is claimed is:

1. A liquid cartridge, comprising:

a housing configured to accommodate a liquid container for storing liquid;

a groove portion formed on an outer surface of the housing;

a liquid lead-out opening, formed on a bottom surface of the groove portion communicating with the liquid container and configured such that a liquid lead-out-path for guiding the liquid inside the liquid container to the outside is connected to or disconnected from the liquid lead-out opening;

a flow path extending toward an inside of the housing from an end of the groove in a liquid dripping direction; and a liquid absorbing member provided at an opposite side to the groove portion of the flow path, wherein the flow path is provided with at least a single rib formed inside the flow path, the rib extending along a direction the flow path extends.

2. The liquid cartridge according to claim 1, wherein a width of the groove portion becomes narrower at a downstream side of the liquid lead-out opening in the liquid dripping direction as it goes in the liquid dripping direction.

3. The liquid cartridge according to claim 2, further comprising a projection portion, that encircles the liquid lead-out opening and projects from a bottom surface of the groove portion, configured to guide the liquid adhering to the projection portion to a side surface of the groove portion.

4. The liquid cartridge according to claim 3, wherein the projection portion includes a slope declining toward the liquid lead-out opening.

5. The liquid cartridge according to claim 3, further comprising:

a sealing rubber attached to the liquid lead-out opening;

wherein the projection portion secures the sealing rubber.

6. The liquid cartridge according to claim 1, wherein the housing includes an absorber chamber accommodating the liquid absorbing member; and wherein a container room accommodating the liquid container is isolated from the absorber chamber.

7. The liquid cartridge according to claim 6, wherein an atmosphere communication port, provided separately from the flow path and configured to establish a communication between the absorber chamber and the outside, is formed on a surface separate from a bottom surface of the groove portion.

8. The liquid cartridge according to claim 6, wherein the housing includes an atmospheric pressure control opening configured to control an atmospheric pressure inside the container room; and wherein the liquid container includes a liquid storage bag made of a flexible material that is deformable according to the atmospheric pressure inside the container room.

9. A liquid cartridge, comprising:

a housing configured to accommodate a liquid container for storing liquid;

a groove portion formed on an outer surface of the housing;

a liquid lead-out opening, formed on a bottom surface of the groove portion communicating with the liquid container and configured such that a liquid lead-out-path for guiding the liquid inside the liquid container to the outside is connected to or disconnected from the liquid lead-out opening;

a flow path extending toward an inside of the housing from an end of the groove in a liquid dripping direction; and a liquid absorbing member provided at an opposite side to the groove portion of the flow path, wherein a width of the groove portion is narrower at a position where the flow path is formed than at a position where the liquid lead-out opening is formed.

10. The liquid cartridge according to claim 9, wherein the flow path is provided with at least a single rib formed inside the flow path, the rib extending along a direction the flow path extends.

* * * * *